US006345849B1

(12) United States Patent
Yen

(10) Patent No.: US 6,345,849 B1
(45) Date of Patent: Feb. 12, 2002

(54) SAFETY DOOR STOPPER

(76) Inventor: Si-Kang Yen, No. 16, Lane 30, Wann-Lih St., Wen-Shan Dist., Taipei (TW)

( * ) Notice: Subject to any disclaimer, the term of this patent is extended or adjusted under 35 U.S.C. 154(b) by 0 days.

(21) Appl. No.: 09/431,069

(22) Filed: Nov. 1, 1999

(51) Int. Cl.[7] ..... E05C 17/54; E05C 19/18

(52) U.S. Cl. ..... 292/343; 292/342; 292/DIG. 15; 292/292; 292/295

(58) Field of Search ..... 292/342, 343, 292/DIG. 15, 292, 295

(56) References Cited

U.S. PATENT DOCUMENTS 3,977,714 A * 8/1976 Trotter ..... 292/343
4,198,088 A * 4/1980 Tochihara ..... 292/288
4,514,000 A * 4/1985 Chezem et al. ..... 292/338
4,673,203 A * 6/1987 Chezem ..... 292/339
4,705,309 A * 11/1987 Sawchuk ..... 292/342
4,736,974 A * 4/1988 Rosenthal ..... 292/343
4,805,948 A * 2/1989 Renzi ..... 292/342
4,881,293 A * 11/1989 Reynolds ..... 16/86
5,056,836 A * 10/1991 Wells ..... 292/288
5,673,952 A * 10/1997 Chezem et al. ..... 292/338
5,711,560 A * 1/1998 Gilbertson ..... 292/343
6,120,072 A * 9/2000 Benedict ..... 292/338
6,161,252 A * 12/2000 Rodriguez ..... 16/82

* cited by examiner

*Primary Examiner*—Anthony Knight
*Assistant Examiner*—Matthew E. Rodgers
(74) *Attorney, Agent, or Firm*—Varndell & Varndell, PLLC

(57) ABSTRACT

A safety door stopper for use in trip, including a wedge stopper block and a coupler member. The coupler member is used to fix the wedge stopper block under a lower edge of the door board. A bottom face of the wedge stopper block is disposed with an unsmooth face. When the wedge stopper block is fixed under the lower edge of the door board, the unsmooth face is able to enlarge the frictional coefficient between the door board and the ground and enlarge the frictional force. Therefore, the resistance against the door board is increased to make it difficult to push open the door board and ensure safety in trip.

1 Claim, 3 Drawing Sheets

SAFETY DOOR STOPPER

BACKGROUND OF THE INVENTION

The present invention relates to a safety door stopper for use in trip, and more particularly to a door stopper including a wedge stopper block and a coupler member. The coupler member is used to fix the wedge stopper block under a lower edge of the door board to increase the resistance against the door board when pushing open the door board so as to ensure safety in trip. The safety door stopper is applicable to push-type door and window.

In a hotel for travelers, the door of the room is often only locked by a simple lock such as trumpet lock and additional slidable chain lock. Such trumpet lock and chain lock both can be unlocked from outer side of the door so that the safety can be hardly ensured. Therefore, the travelers often feel worried and the quality of the sojourn is affected.

Some hotels provide wedge block for increasing the resistance against the pushing force exerted onto the door. However, such wedge block generally has heavy weight and is uneasy to carry. In addition, the wedge block is attached to the lower edge of the door board so that an unauthorized person can easily push away the wedge block through the gap between the lower edge of the door board and the ground to release the door from the resistance. Therefore, it is necessary to provide a portable door stopper for a traveler himself/herself to enhance the locking effect for the door so as to ensure safety in trip.

SUMMARY OF THE INVENTION

It is therefore a primary object of the present invention to provide a safety door stopper which is composed of simple and light components for a traveler to easily carry. The door stopper provides a strong stopping force to make it difficult to push open the door board so as to ensure safety in trip.

It is a further object of the present invention to provide the above safety door stopper which is firmly fixed with the door board and cannot be moved away from outer side of the door so that the safety can be ensured.

According to the above objects, safety door stopper for use in trip of the present invention includes a wedge stopper block and a coupler member. The bottom face of the wedge stopper block is disposed with an unsmooth face. The wedge stopper block is coupled with the coupler member. The coupler member is fixed under a lower edge of a door board with the wedge stopper block positioned between the lower edge of the door board and the ground. The unsmooth face is able to enlarge the frictional force between the door board and the ground so that the resistance against the door board is increased to make it difficult to push open the door board. It is unnecessary for the wedge stopper block to have too heavy weight so that a user can easily carry the wedge stopper block.

The present invention can be best understood through the following description and accompanying drawings wherein:

DETAILED DESCRIPTION OF THE PREFERRED EMBODIMENT

Figure 1:
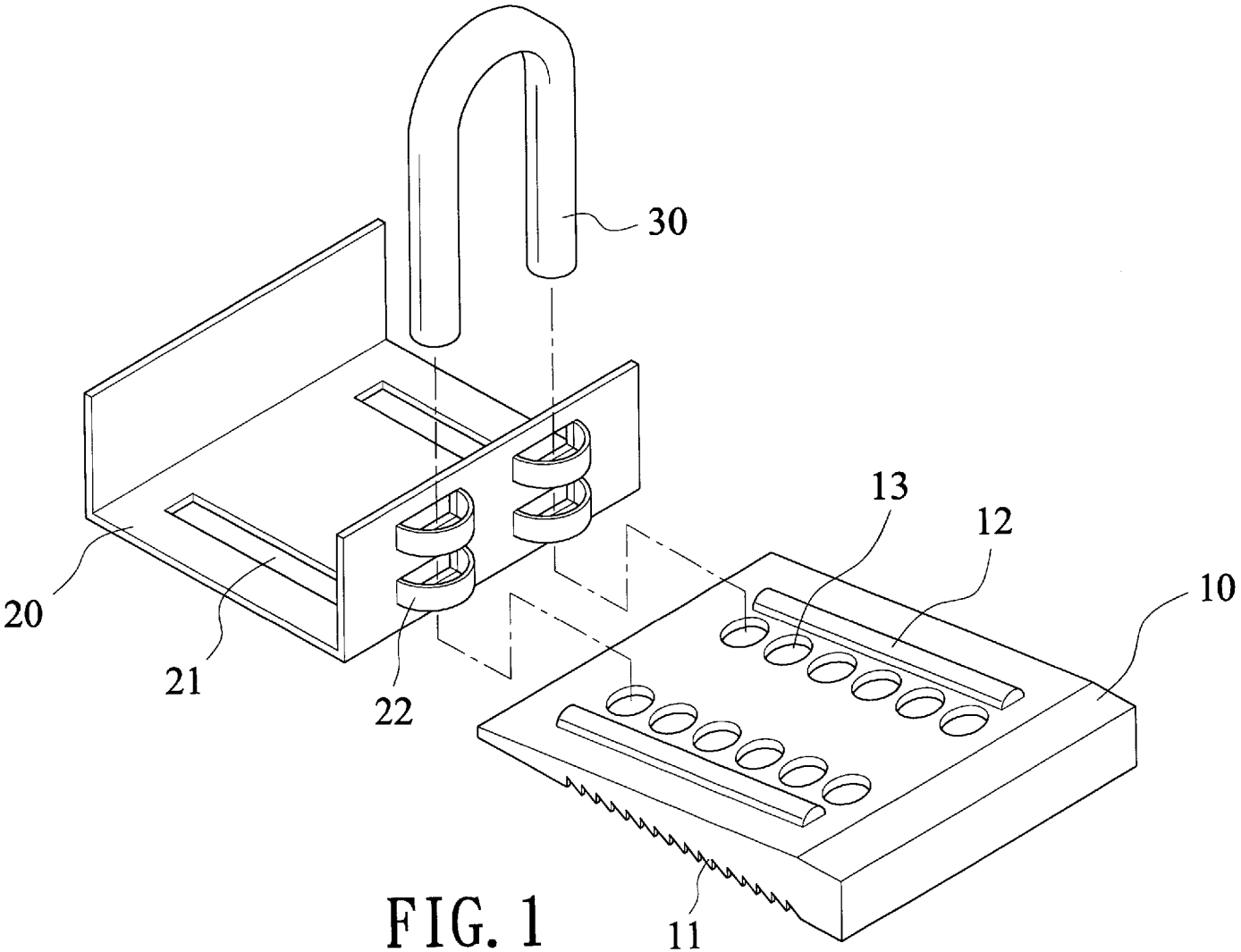
FIG. 1 is a perspective exploded view of the safety door stopper of the present invention.
Figure 2:
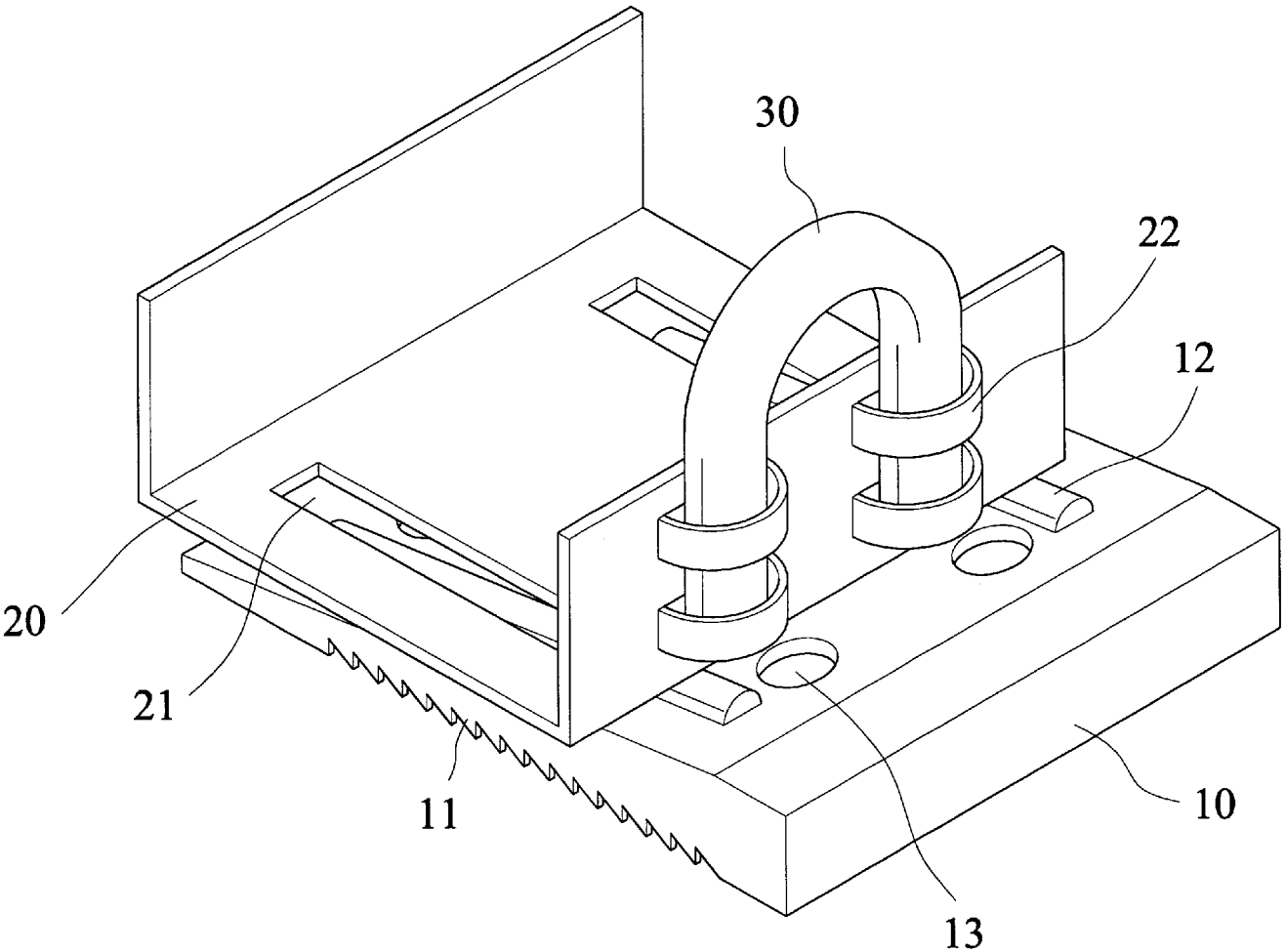
FIG. 2 is a perspective assembled view of the safety door stopper of the present invention.

Please refer to FIGS. 1 and 2. The safety door stopper of the present invention includes a wedge stopper block 10 and a coupler member 20. The coupler member 20 is a substantially U-shaped structure made of concrete material. The bottom of the coupler member 20 is formed with two slots 21. A lateral side of the coupler member 20 is disposed with multiple semicircular projecting rings 22. The slots 21 are perpendicular to the lateral side of the coupler member 20. The projecting rings 22 are arranged into two rows. The centers of the projecting rings 22 of each row are aligned with each other.

The wedge stopper block 10 is a wedge block. The bottom face of the wedge block is formed with a ratchet face 11. Two sides of the slope face of the wedge block are disposed with two ribs 12. Two rows of holes 13 are formed between the two ribs 12.

Figure 3:
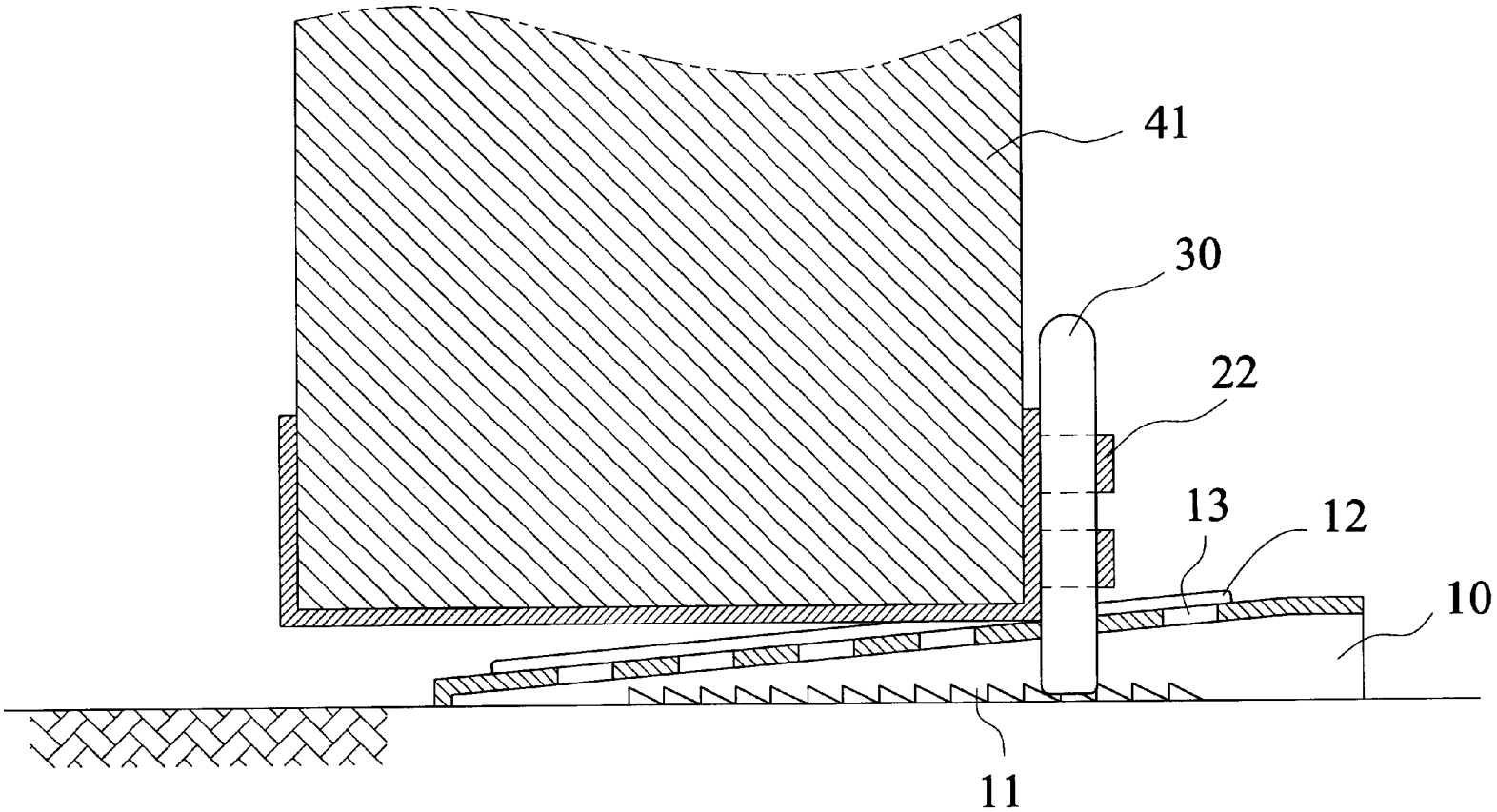
FIG. 3 is a sectional view showing the application of the safety door stopper of the present invention.

In use, referring to FIG. 3, the coupler member 20 is slided into the lower edge of the door board 41. The front end of the wedge stopper block 10 abut against the lower side of the coupler member 10 and the ribs 12 are inserted into the slots 21. Two ends of a reverse U-shaped pin member 30 are respectively passed through the centers of the projecting rings 22 of the coupler member 10 and inserted into suitable holes 13 of the wedge stopper block 10.

When pushing and opening the door board 41, it is necessary to overcome the resistance of the wedge stopper block 10. The wedge structure of the front end of the wedge stopper block 10 is able to convert the horizontal force into upward force. Therefore, it is laborious to exert a horizontal force onto the door board. In addition, the ratchet face 11 greatly enlarges the frictional coefficient between the wedge stopper block 10 and the ground so that the frictional force is enlarged. Moreover, the ratchet face 11 is able to provide a one-way braking effect with respect to the ground. This increases the resistance against the door board and makes it more difficult to overcome the resistance. Therefore, the door board 41 of the room is tightly locked and cannot be pushed open.

The wedge stopper block 10 and the coupler member 20 are integrally locked with the door board 41. In use, it is impossible to from outer side of the door push the wedge stopper block 10 away from the lower edge of the door board 41 so as to unlock the door. In the case that the door board 41 is pushed forward, there is a very great resistance against the door board so that the door board cannot be opened. In the case that the door board is pushed left or right, the wedge stopper block 10 and the coupler member 20 will move along the lower edge of the door board 41 without detaching from the door board 41. Therefore, the resistance will always exist to prevent the door board 41 from being pushed open. Therefore, only the user can remove the wedge stopper block 10 indoors so that the safety can be ensured.

The ratchet face 11 of the wedge stopper block 10 enlarges the frictional coefficient and enlarges the frictional force so that a sufficient resistance can be created without exerting a great normal force. Therefore, the wedge stopper block 10 can have light weight and small volume for easy carriage. The connection between the wedge stopper block 10 and the coupler member 20 is achieved by inserting the ribs 12 into the slots 21 and enhanced by the pin member 30. The connection between the ribs 12, slots 21 and the pin member 30 are achieved by simple structure and can be easily released. In addition, the holes 13 are formed at different positions so that the wedge stopper block 10 can be fixed under the lower edges of the door boards 41 which have different gaps from the ground. Accordingly, the wedge stopper block 10 and the coupler member 20 can be conveniently and easily positioned under the lower edges of different door boards 41 and removed therefrom.

The above embodiment is only used to illustrate the present invention, not intended to limit the scope thereof Many modifications of the above embodiment can be made without departing from the spirit of the present invention.

What is claimed is:

1. A safety door stopper for use during travel comprising a wedge stopper block and a coupler member, the wedge stopper block having a roughed bottom face, the wedge stopper block being coupled with the coupler member, the coupler member being a substantially U-shaped member disposed on a lower edge of the door board and fixed under the lower edge of a door board with the wedge stopper block positioned between the lower edge of the door board and the ground, wherein a lateral side of the coupler member is disposed with multiple semicircular projecting rings and a slope face of the wedge stopper block is formed with multiple holes, whereby a pin member is passed through the projecting rings and inserted into the holes of the wedge stopper block so as to integrally connect the coupler member with the wedge stopper block.

* * * * *